US005217277A

United States Patent [19]

Rasnick et al.

[11] Patent Number: 5,217,277

[45] Date of Patent: Jun. 8, 1993

[54] SEAT ARM WITH CONCEALED TABLE

[75] Inventors: Glen L. Rasnick; Larry Smith, both of Morristown; James Mitchell, Talbott; Kenneth C. Peacock, Morristown, all of Tenn.; Ronald H. Cordover, Franklin Lakes, N.J.

[73] Assignee: The Berkline Corporation, Morristown, Tenn.

[21] Appl. No.: 881,344

[22] Filed: May 11, 1992

[51] Int. Cl.[5] ..... A47B 83/02; A47C 7/70

[52] U.S. Cl. ..... 297/145; 297/194

[58] Field of Search ..... 297/14, 145, 146, 191, 297/194

[56] References Cited

U.S. PATENT DOCUMENTS

| | | | |
|---|---|---|---|
| 624,812 | 5/1899 | Hunzinger . | |
| 1,191,307 | 7/1916 | Hornschueh | 108/38 X |
| 1,726,109 | 8/1929 | Jost . | |
| 1,753,423 | 4/1930 | Kroschel | 108/38 X |
| 1,907,322 | 5/1933 | Keicher | 297/145 |
| 2,173,569 | 9/1939 | Troendle | 297/146 |
| 2,502,383 | 3/1950 | Loewy | 297/194 X |
| 2,767,771 | 10/1956 | Leonard . | |
| 3,042,467 | 7/1962 | Germick . | |
| 4,953,771 | 9/1990 | Fischer . | |

FOREIGN PATENT DOCUMENTS

| | | | |
|---|---|---|---|
| 2006317 | 8/1971 | Fed. Rep. of Germany | 297/194 |
| 531205 | 4/1955 | Italy | 297/194 |
| 217037 | 6/1924 | United Kingdom . | |

*Primary Examiner*—Peter R. Brown
*Attorney, Agent, or Firm*—David D. Kaufman

[57] ABSTRACT

A collapsible table is concealed and stored in the hollow chamber of an upholstered seat arm. The table is pivotally connected to the seat arm by a two-segment spar which supports the table in the extended position and is collapsible for returning the table to the stored position in the arm chamber. A handle is easily manipulable by a seat occupant for collapsing the spar and returning the table to its storage position. The outer upholstered panel of the arm carries the male member of a latch for pivotal movement of the panel to permit access to the chamber and extension of the table. The table carries a cup holder which is pivotal between concealed and extended positions and which is automatically returned to its concealed position by engagement with the front post of the arm when the table is returned to its storage position.

8 Claims, 2 Drawing Sheets

SEAT ARM WITH CONCEALED TABLE

TECHNICAL FIELD

This invention relates generally to upholstered seats such as, lounge chairs, recliner chairs, settees, sofas, and the like, and, more particularly, to an upholstered seat having concealed in an arm thereof a readily accessible table and other utilitarian structures.

BACKGROUND OF THE INVENTION

Seats of various types having extensible and retractable tables associated with an arm thereof have long been known in the furniture industry. Owing, however, to a number of disadvantageous characteristics, prior seats of the type described have not met with great favor.

An early example of a prior chair with a pivotable table attached to the arms is U.S. Pat. No. 624,812. That arrangement was inconvenient because the table had to be grasped at the bottom for opening, the outer side wall surface itself comprised the table, and the design did not lend itself to contemporary upholstered styling. Upholstered chairs with extensible tables may be seen in U.S. Pat. Nos. 1,726,109; 1,907,322; 2,767,771; and British Patent Number 217,037, all of which exhibit undesirable features. Thus, for example, the '109 patent requires a complicated and design-inhibiting system of tracks and slides; the '322 patent has the table affixed and pivotally attached to the arm side panel and a complex linkage system; patent '771 shows a bulky structure in which the table surface comprises the outer side wall upholstered surface; and the British patent undesirably has the door or arm side panel extending and lying far out on the floor.

There thus exists a need for an upholstered seat with a concealed and extensible table that overcomes problems of the type described.

BRIEF SUMMARY OF THE INVENTION

The present invention provides a seat arm having a concealed table as well as other utilitarian structures. The arm and table arrangement is extremely simple and conveniently easy to operate and, when the table is in the concealed inoperative position, there is no visible evidence of its presence to interfere with the cosmetic styling of the chair.

Briefly, the invention comprises a table member hingedly mounted to the chair frame and adapted to hang downwardly and concealed within the conventional hollow space of an upholstered chair arm. A two-piece, spring-loaded support beam or spar is pivotally connected between the chair frame and the underside of the table member whereby the table may be readily pivoted outwardly and securely retained in the extended position. A cup holder/ashtray is pivotally secured to the underside of the table whereby the same may be readily pivoted outwardly for use when the table is extended. Handle means is provided for collapsing the spar and returning the table to the concealed position. During the table-returning operation, the cup holder cooperates with the front post of the chair arm to automatically pivot the cup holder back to the stored position.

The arm outer wall panel is hingedly connected to the chair frame and upholstered or trimmed in the same manner as the remainder of the chair or seat. Internal latch means operable to grip or release by inward push is provided between the outer panel and the chair frame. As a result, when the arm and table are in the stored condition, there is no visible evidence of the table's presence. The inner surface of the outer arm panel carries a magazine rack and is also provided with frictional snap means for frictionally engaging a support arm depending from the table when the latter is in the extended position. As a result, the operationally opened arm and extended table occupy a minimum of space and present an attractive appearance. Opening, closing, latching and unlatching of the various movable members may be conveniently and easily accomplished by the chair occupant while comfortably seated.

Numerous other advantages and features of the present invention will become apparent from the following detailed description of the invention, from the claims and from the accompanying drawings.

BRIEF DESCRIPTION OF THE DRAWINGS

In the accompanying drawings forming a part of the specification, and in which like numerals are employed to parts throughout.

DETAILED DESCRIPTION OF THE INVENTION

As used herein, the term "seat" is intended in its broadest sense to apply to all forms of seating furniture including, recliner chairs, rocker chairs, lounge chairs, sofas, settees, and the like. Also, since the seat itself is not a part of the present invention, only so much thereof as is necessary for an understanding of the present invention will be described.

Figure 1:
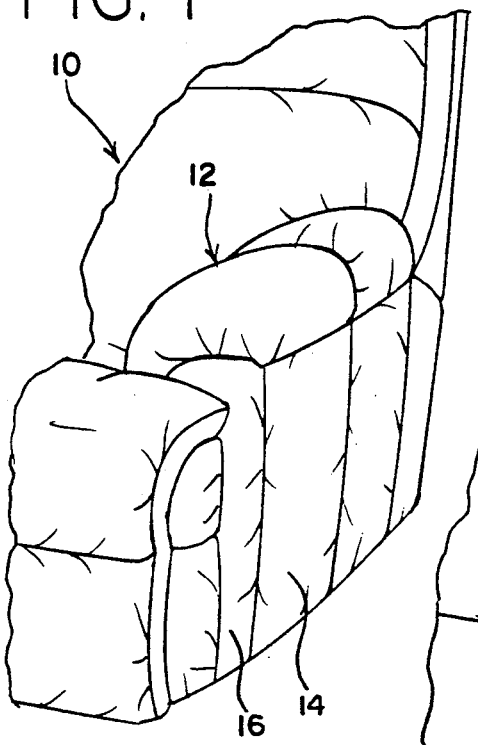
FIG. 1 is a fragmentary perspective view of a seat with an arm embodying the principles of the invention.

Turning to FIG. 1 of the drawings, there is shown an upholstered seat 10 having a padded side arm 12 and an upholstered outer arm panel 14, said side arm including a front post 16. As illustrated in FIG. 1, the seat 10 appears in all respects conventional and presents no evidence of the incorporation therein of the present invention. The side arm 12 is conventionally hollow, thereby comprising an internal cavity or chamber, such as 18. The cavity 18 provides a housing for retaining therein a table 25 and other utilitarian structures as subsequently will be described.

Figure 3:
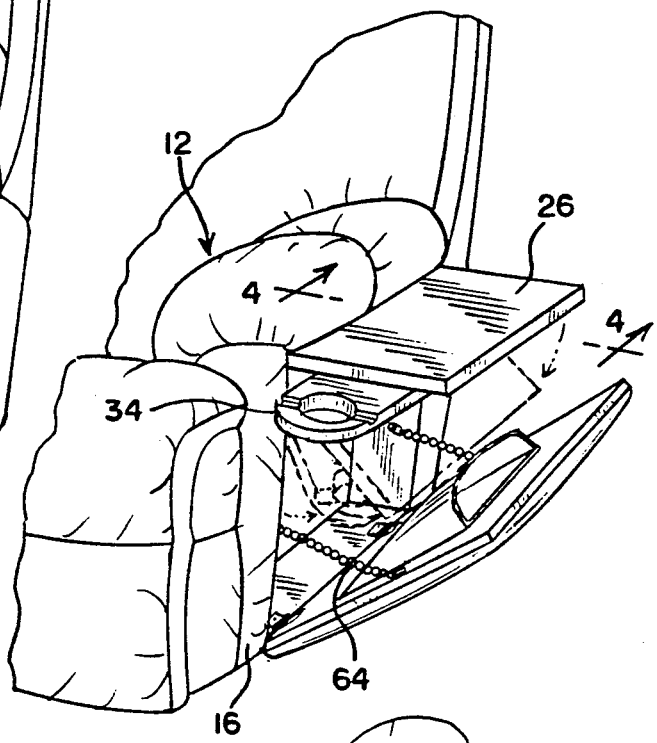
FIG. 3 is a perspective view showing the table and cup holder in the operational extended position.
Figure 2:
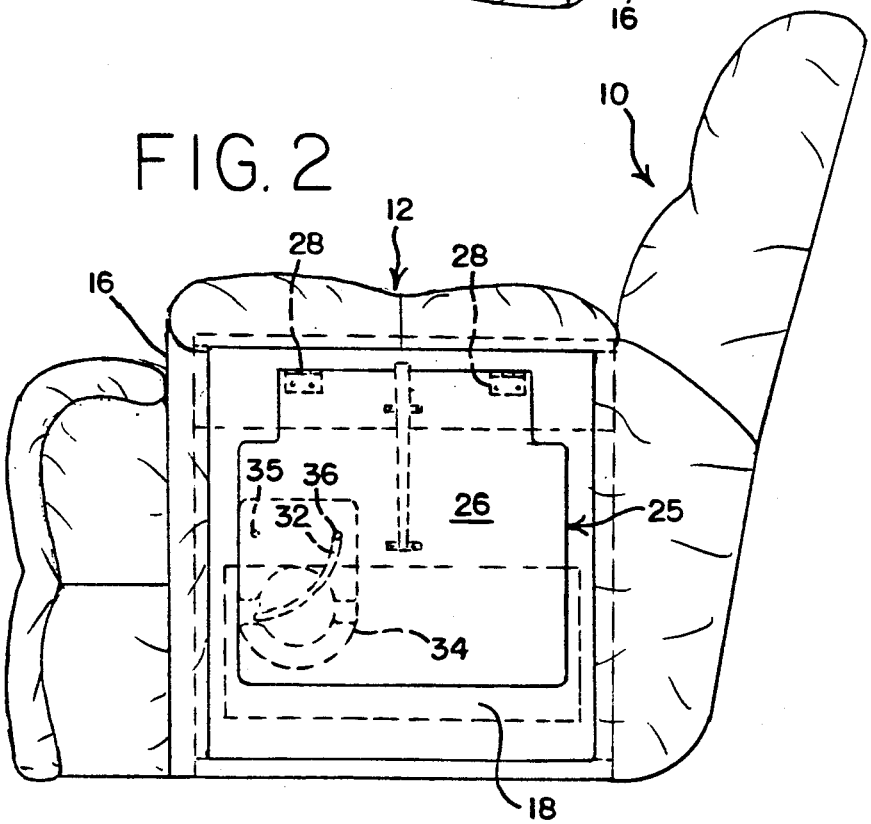
FIG. 2 is a side elevation with the seat arm outer panel removed to show the relationship of the table components in the stored condition.

Table 25 comprises a planar table panel 26 whose inner or top edge is hingedly connected, as at 28, to a seat structural member such as 30. On its inner or undersurface 27, the table panel 26 comprises an arcuate slot 32 (see FIG. 2). A cup holder/ashtray 34 is pivotally mounted to the inner table surface 27 at 35 and said cup holder/ashtray also comprises a connector 36 which slidably is captive within the slot 32. It will thus be seen that the cup holder/ashtray 34 is pivotable between a stored position (FIG. 2) and an extended, operational position (FIG. 3), being at all times supported at two connector points 35 and 36.

A collapsible support beam or spar 38 is pivotally connected between the table panel 26 and a support member 40 in the arm 12. Spar 38 comprises a first or inner section 42 pivotally connected to the member 40 and a second or outer section 44 pivotally connected at 46 to the table inner surface 27. The spar sections 42 and 44 are pivotally connected at 48 and said sections are tensioned by an inner spring 50 which functions as an over-center spring means for retaining the spar in the operational supporting position of FIG. 4 and for urging the spar into a collapsed condition as in FIG. 2.

Figure 5:
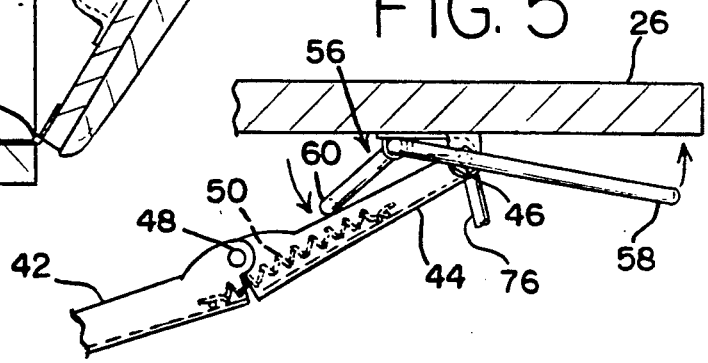
FIG. 5 is an enlarged detail view showing the handle and its movement to break or collapse the spar and table.

The spar 38 is pivotally connected to the inner table surface 27 by a mounting plate 52 comprising the pivot point 46 and a pair of saddles 54. A bent wire handle member 56 having a handgrip segment 58 and a pressure or camming segment 60 is pivotally retained in the saddles 54 of the mounting plate 52. As indicated in FIG. 5, pivoting of the handgrip segment 58 causes the camming segment 60 to pivot or bend the spar section 44 until the spring 50 causes collapse of the spar for return of the table 25 to the stored position. The spar 38 is a commercially available structure.

Outer arm panel 14 is hingedly connected at its bottom edge 62 to a bottom rail or base member 63 of the chair arm 12 and also by a pair of retainer bead chains 64. A magazine rack 66 is conveniently mounted on the inner surface 15 of the panel 14. For purposes of retaining the panel 14 in the closed position of FIG. 1 and releasing the same to the open position of FIGS. 3 and 4, there is provided a two-part latch of known construction and operation. The latch comprises a receiver member 68 having a spring-loaded clamshell grip mounted on a horizontal top rail or arm support member 70 and a ball-tipped latching post 72 on the inner surface 15 of the outer panel 14 aligned with the receiver. The described latch operates on the principle of push-to-close and push-to-open. When use of the table 25 is desired, it is simply necessary to apply inward pressure to the arm outer panel 14 whereupon the receiver member 68 releases the post 72 and automatically springs the said panel outwardly away from the arm so that further manipulation may be conveniently applied by the chair occupant.

Figure 4:
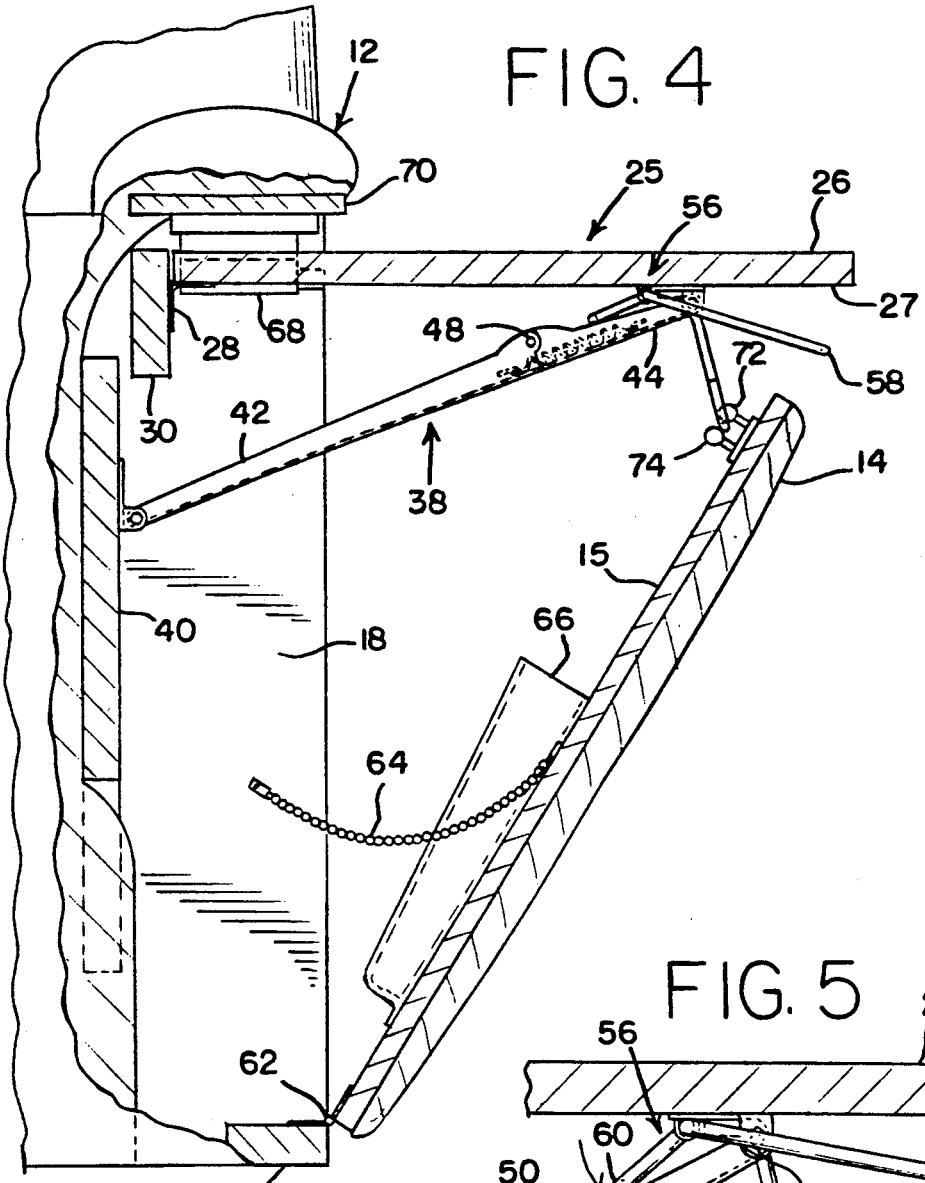
FIG. 4 is an enlarged vertical sectional view substantially on the plane of line 4—4 of FIG. 3.
Figure 6:
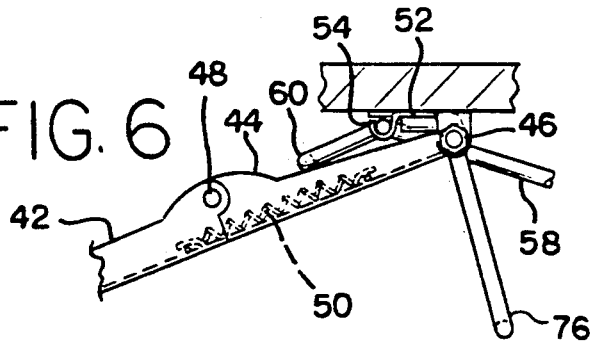
FIGS. 6 and 7 are detail views of the table bracket and cooperating snap engaging means on the seat arm outer panel.
Figure 7:
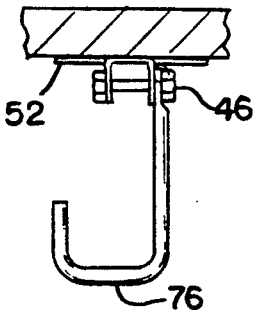

Referring to FIGS. 4, 6 and 7, it will be noted that the invention comprises a second ball-tipped post 74 mounted on arm panel inner surface 15 in spaced relationship with the post 72. Cooperable with the posts 72 and 74 is a latching bracket 76 which is mounted on the pivot point 46 so that the same is pivotal in only one direction, counterclockwise as viewed in FIG. 6. After the table 26 has been extended to the operational position of FIG. 4, the outer arm panel 14 may be pivoted back toward the arm until the posts 72 and 74 snap engage the bracket 76, thereby providing a neat appearance for the convertible arm when the table is extended. To return the table to the stored position, it is simply necessary to pivot the panel 14 outwardly to disengage the hook 76 and then proceed to collapse the spar 38 as already described.

During collapse of the spar 38 and return of the table 25 to the stored position, there is a desirable interaction between the cup holder/ashtray 34 and the arm front post 16. As indicated by the dotted line shown in FIG. 3, the descending table 25 causes the cup holder/ashtray to bear against the front post 16 to automatically pivot said cupholder/ashtray which travels in the arcuate slot 36 and into the stored position. When the table has reached the stored position of FIG. 2, the chair occupant need simply move the outer arm panel 14 inwardly until the latching post 72 is firmly engaged by the latch receiver member 68.

From the foregoing description, it should be apparent that the invention provides a novel arm for an upholstered seat which is conveniently and readily convertible into an extended table, cupholder/ashtray and magazine rack, all in a neat appearing and firmly supported arrangement. When in the closed condition, the convertible arm gives no indication of the concealed structures and does not detract from the overall cosmetic styling of the chair. It should also be understood that the language employed herein is for purposes of description rather than limitation, and various changes can be made without departing from the spirit or scope of the invention which is defined in the appended claims.

What is claimed is:

1. In an upholstered seat having a side arm with a front post, an outer panel having inner and outer surfaces defining a chamber in said arm, and hinge means mounting the outer panel to the side arm for pivotal movement to permit access to the chamber, a collapsible table comprising:

a table panel pivotally mounted in the chamber and pivotal between a stored position concealed within the chamber and an extended operational position;

a support spar pivotally connected between said table panel and the side arm and operational to support said table panel in the extended position and collapsible to return said table panel to the stored position;

handle means mounted from said table panel and movable for collapsing said support spar to return said table panel to the stored position;

latch means on said outer panel and side arm cooperable to retain said outer panel in the chamber-closing position and to release said outer panel to permit access to the chamber; and a cup holder pivotally mounted to an undersurface of said table panel and pivotal between a concealed position beneath said table panel and an extended position projecting away from said table panel, said cup holder bearing against the front post when the panel is returned to the stored position to automatically pivot said cup holder to the concealed position.

2. The upholstered seat of claim 1 comprising an arcuate guideway in the undersurface of said table panel and a slidable connector on said cup holder retained in said guideway so that the cup holder is supported on said table panel at two points.

3. The upholstered seat of claim 1 comprising a magazine rack mounted on the inner surface of said outer panel.

4. In an upholstered seat having a side arm with a front post, an outer panel having an inner surface and an upholstered outer surface defining a chamber in said arm, and hinge means mounting the outer panel to the side arm for pivotal movement to permit access to the chamber, a collapsible table comprising:

a table panel pivotally mounted in the chamber and pivotal apart from the outer panel between a stored position concealed within the chamber and an extended operational position;

a support spar pivotally connected between said table panel and the side arm and operational to support said table panel in the extended position and collapsible to return said table panel to the stored position;

handle means mounted from said table panel and operable by an occupant while seated in the seat for collapsing said support spar whereby said table panel returns automatically to the stored position;

latch means on said outer panel and side arm cooperable to retain said outer panel in the chamber closing position and to release said outer panel to permit access to the chamber; and a latching bracket dependingly associated with said angle panel and snap-engaging means mounted on the inner surface of said outer panel and cooperable with said bracket for frictionally connecting said outer panel to said table panel when in the extended operational position.

5. A convertible arm for an upholstered seat comprising:

an outer arm panel having inner and outer surfaces pivotally connected to the seat and pivotal between a normal closed position and an open position permitting access to an inner chamber in said arm;

latching means on the inner surface of said outer arm panel and in said arm chamber cooperable for retaining said outer arm panel in the normal closed position and releasing said outer arm panel to the open position;

a table pivotally mounted in the chamber and pivotal between an inactive stored position and an operational extended position;

a support spar pivotally connected between said table and an element of said arm in said chamber for supporting said table in the operational extended position, said spar comprising a pair of pivotally connected segments collapsible upon themselves for returning said table to the inactive stored position;

a handle pivotally mounted from said table and engageable with a segment of said spar for collapsing the spar to return the table to the inactive stored position; and a cup holder pivotally mounted to the undersurface of said table and pivotal between a concealed position beneath said table and an extended position projecting away from said table, said holder bearing against a front member of the arm when the table is returned to the stored position to automatically pivot said cup holder to the concealed position.

6. A convertible arm according to claim 5 comprising an arcuate guideway in the undersurface of said table and a slidable connector on said cup holder retained in said guideway so that the cup holder is supported on said table at two points.

7. A convertible arm according to claim 6 comprising a latching bracket dependingly associated with said table and snap-engaging means mounted on the inner surface of said outer panel and cooperable with said bracket for frictionally connecting said outer panel to said table when in the extended operational position.

8. A convertible arm according to claim 7 comprising a magazine rack mounted on the inner surface of said outer panel.

* * * * *